United States Patent [19]

Wüthrich

[11] 4,403,981

[45] Sep. 13, 1983

[54] FOLDING MACHINE

[75] Inventor: Werner Wüthrich, Gümligen, Switzerland

[73] Assignee: Hasler AG, Bern, Switzerland

[21] Appl. No.: 352,056

[22] Filed: Feb. 24, 1982

[30] Foreign Application Priority Data

Feb. 26, 1981 [CH] Switzerland ..... 1321/81

[51] Int. Cl.[3] ..... B65H 45/14

[52] U.S. Cl. ..... 493/419; 493/249; 493/420; 493/442; 493/453

[58] Field of Search ..... 493/419–421, 493/424, 425, 433–435, 442, 443, 249, 451–454, 448, 456, 460, 388, 247, 260, 262; 53/10, 28, 32, 117, 120, 429, 376

[56] References Cited

U.S. PATENT DOCUMENTS 4,010,598 3/1977 Mueller ..... 493/419 X

*Primary Examiner*—A. J. Heinz

*Attorney, Agent, or Firm*—Brady, O'Boyle & Gates

[57] ABSTRACT

The material to be folded (a, b) and consisting of one or several sheets is introduced into a flat cartridge (1) up to the point (A) of the fold to be formed by means of a pair of supply rollers (29, 30). Subsequently, the cartridge (1) is turned around an axis (2) in a right angle to the introductory direction whereby a feed roll (9) presses temporarily the point (A) of the material to be folded (a, b) against the edge (6) of the cartridge at which it was introduced and folds the material to be folded (a, b) thus over the edge (6) at this point (A). Finally, the material to be folded (a, b) is taken over by a pair of folding rollers (11, 12) with the top of the thus formed fold leading which presses the fold together. During this process, the portion (a) of the material to be folded introduced into the cartridge (1) remains constantly plane so that, for example, a credit card or a flat sample can be attached with paper clips at this portion without impeding the operation of the folding station or making it more difficult.

9 Claims, 23 Drawing Figures

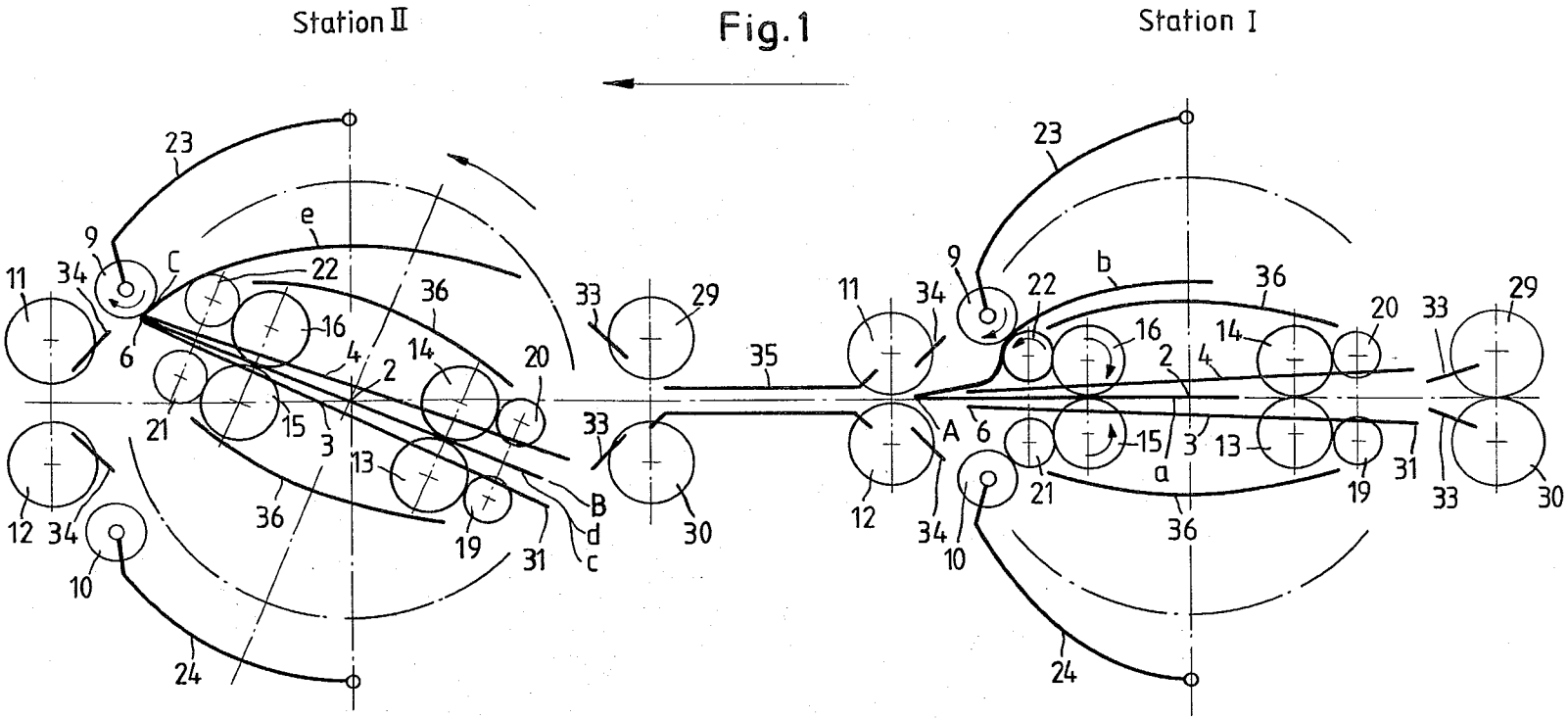
Station I
Station II
Fig.1
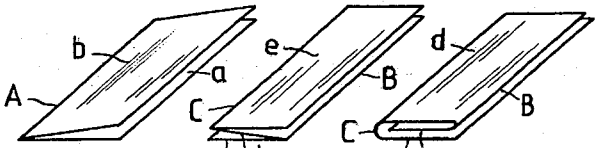
Fig.2
Fig.3
Fig.4

FOLDING MACHINE

BACKGROUND OF THE INVENTION

The invention concerns a folding machine for sheets of papers, particularly for the folding of mailing material in envelope insertion machines.

SUMMARY OF THE INVENTION

The invention is based on the task of providing such a machine which meets the following conditions: it shall be possible to adjust the machine to different types of folds, such as simple fold, Z fold, rolling fold, and different formats, without any structural change, just by changing the control program (sense of direction, length of advance). Also, it shall be possible, without causing any difficulty, to reverse the direction of turning during the folding process. The machine shall make it possible to hold reliably even a small section of the material to be folded during the folding process. The shank lengths of the folds shall be feeely selectable and simply adjustable within a large range. In particular, it shall be possible to fold, without any problem, material with inflexible components, for example, paper clips or credit cards or parts of samples (outside these components).

This task is accomplished by the folding machine according to the present invention.

An exemplified embodiment of the invention is further described hereinafter following by reference to the accompanying schematic drawings.

BRIEF DESCRIPTION OF THE DRAWINGS

FIG. 1 shows a schematic lateral view of two successive folding stations of a folding machine according to the invention;

FIGS. 2 to 4 show a simple fold, a Z fold and a rolling fold each;

FIGS. 11, 12 and 17 to 20 show the processes of the production of the second folding of a rolling fold in a like folding station;

DESCRIPTION OF THE PREFERRED EMBODIMENTS

Figure 5:
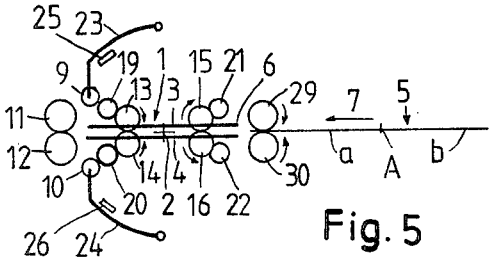
FIGS. 5 to 10 show the processes of the production of a simple fold in a folding station.
Figure 14:
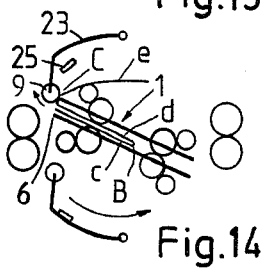
Figure 18:
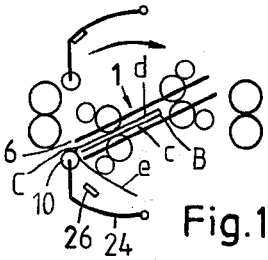

Independently of what kind of a fold (A, B or C in FIGS. 2 to 4) is to be formed, the folding station—as can be noticed, for example, from FIG. 5—has a cartridge 1 which is rotational around an axis 2 (indicated in FIGS. 1, 5, 7 and 11 by means of a center line cross). The cartridge 1 has two guide walls 3 and 4 between which the material to be folded 5 (or 32 in FIG. 11) is introduced so far that the point A (or C in FIG. 11) at which the fold is to be formed is located at the edge 6 of the introductory side of the cartridge 1. The material to be folded 5 (or 32 in FIG. 11) can be a sheet of paper or can consist of several sheets put on top of each other which must not be necessarily of the same size. It can have inflexible components, such as paper clips, a credit card or, for example, a flat inflexible sample whereby, in case of several non-identical sheets and/or in case of inflexible components, the material 5 (or 32) must be introduced into the cartridge 1 in such a fashion that the smaller sheets enter the cartridge 1 at least partially and inflexible components entirely, i.e. in the introductory direction 7 in front of the fold to be produced at A (or C). The portion a of the material 5 (or the portions c, d of the material 32) introduced so far into the cartridge 1 remains actually plane during all processes as will be noticed from what follows, it is fixed in the cartridge 1 as will be further explained below. The axis 2 runs transversely to the introductory direction 7 and in parallel to the guide walls 3 and 4. With a 180° turn of the cartridge 1, the cartridge edge 6 at which the portion a of the material 5 (or c, d of the material 32) was introduced passes a spring-loaded feed roll, i.e. with a counterclockwise turn the feed roll 9, FIG. 8 and 14, and with an opposite turn the feed roll 10, FIG. 18. In this instance, the point A (or C) of the material to be folded 5 (or 32) is rolled to the cartridge edge 6 and is folded around it at the strip of the edge adjacent to it on the outside of the cartridge because the feed roll 9 or 10 runs then across this strip of the edge. A pair of folding rollers 11, 12 takes over the material 5 (or 32) folded in this way from the cartridge 1 after the completion of the 180° turn of the cartridge 1 and presses the fold together, FIGS. 10, 16, 20, as can be noticed for a simple fold (FIG. 2) from FIGS. 5 to 10, for the second fold of a Z fold (FIG. 3) from FIGS. 11 to 16 and for the second fold of a rolling fold (FIG. 4) from FIGS. 11, 12 and 17 to 20 and as it is further described below.

Figure 7:
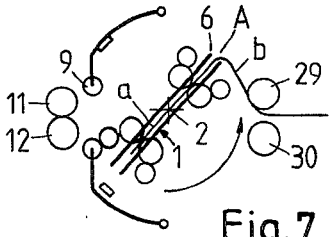
Figure 13:
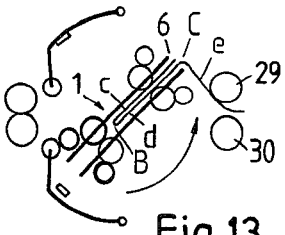
Figure 17:
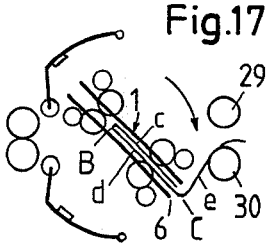
Figure 8:
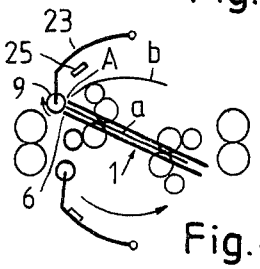
Figure 10:
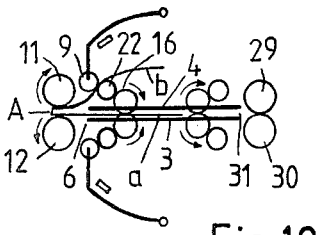
Figure 16:
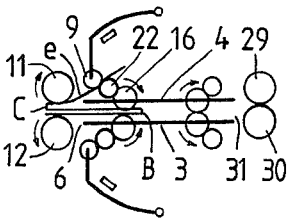
Figure 20:
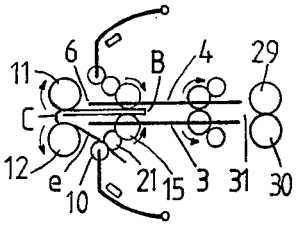
Figure 21:
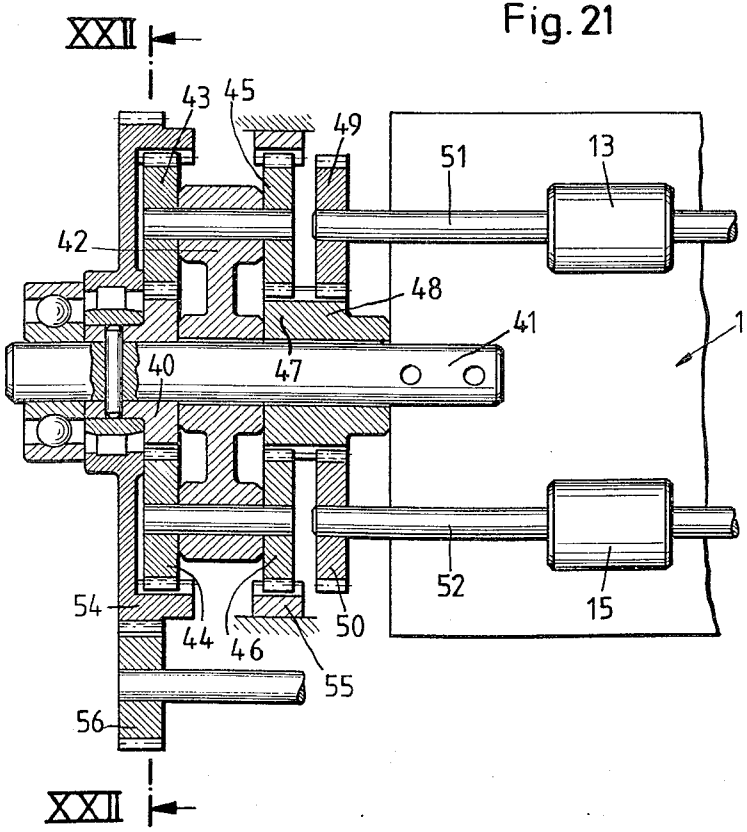
FIG. 21 shows an axial longitudinal section through a gear for the driving of the folding station with the transport rollers.

The cartridge 1 is equipped with two pairs of transport rollers 13, 14 and 15, 16 which are supported on the outside of the guide walls 3 and 4, project through recesses of the guide walls and are driven by means of a gear which is further explained below in connection with FIGS. 21/22 or 23 in the initial position of the cartridge 1 (FIGS. 5 and 11) before its turn and in its final position (FIGS. 10, 16, 20) after the turn in order to interact with the introduction of the portion a of the material 5 (or c, d of the material 32) which is to be introduced into the cartridge 1 as can be noticed from FIGS. 5 and 6 (or 11 and 12) and in order to transfer the material only slightly folded at the edge 6 of the cartridge to the rotating pair of folding rollers 11, 12 (FIGS. 10, 16, 20). During the turn of the cartridge 1, the transport rollers 13, 14 and 15, 16 stand still relative to the cartridge 1 and hold thus the portion a of the material 5 (or c, d of the material 32) introduced into the cartridge 1 in this cartridge 1 (FIGS. 7, 8; 13, 14 or 17, 18).

To each roller of the pairs of transport rollers 13, 14 and 15, 16, one of four additional rollers 19 to 22 is assigned which is arranged at a distance from the transport roller which permits the feed roll to run over the strip at the edge and which is driven with its circumferential velocity due to the fact that the rollers assigned to each other are connected in a shape locked or power locked manner through friction with accordingly dimensioned gear wheels meshed with each other (not shown). The feed rolls 9, 10 are each rigidly connected with a gear wheel (not shown) which meshes with the gear wheel of one of the additional rollers 19 to 22 in the position of FIG. 10 or 15 or 20 whereby the rollers, for example, 9 and 22, have the same circumferential speed.

The feed rolls 9 and 10 rest on arms 23, 24 whose movement is limited by stops 25, 26 whereby, for example, the arm 23 in FIG. 8 has a greater distance from the stop 25 than in FIGS. 9 and 10 so that the feeding force of the feed roll, for example, 9, which is springloaded as was mentioned before, is the highest when it runs across the edge 6 of the cartridge and it is lower when it runs subsequently across the additional roller 22 (FIG. 9) or rotates with it (FIG. 10).

Figure 6:
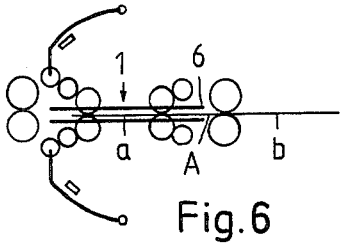

In order to fold one or several sheets on top of each other along a center line for the formation of a simple fold (FIG. 2), the material to be folded, as has already been described in part and shown in FIGS. 5 and 6, introduced into the cartridge 1 up to the point A at which the folding is to be effected (in the example a center line of the material to be folded 5). For this purpose, the pair of supply rollers 29, 30 and the pairs of transport rollers 13, 14 and 15, 16 are driven with the same circumferential speed corresponding to the advance length necessary, for example, by means of an accordingly controlled stepping motor (not shown). Subsequently, the distance of the supply rollers 29, 30 is extended in such a fashion that the part b of the material to be folded 5 which remains outside the cartridge 1 can be freeely pulled through beween the supply rollers 29 and 30 and the cartridge 1 is turned around its axis 2 whereby the transport rollers 13, 14 and 15, 16 stand still relative to the cartridge 1 and hold the material to be folded 5. FIGS. 7 and 8 show the turn of the cartridge 1. When the edge 6 of the cartridge at which the portion a of the material to be folded 5 was introduced into the cartridge 1 passes the feed roll 9, the latter rolls point A of the material to be folded 5 over this edge 6 and folds this material to be folded 5 around the edge 6 at point A of which FIG. 8 shows the initial phase. In the subsequent phase (which is not shown), the feed roll 9 rolls a short distance on the outside of the cartridge 1 whereby the material to be folded is folded by 180°. Then, the feed roll runs on the roller 22. When the turn of the cartridge reaches 180°, its edge 6 is in front of the pair of folding rollers 11, 12, FIG. 9. Now, the pairs of transport rollers 13, 14 and 15, 16 are driven in an advance controlled manner in the direction opposite to the one in which they were driven previously (FIG. 1) for the introduction of the portion a of the material to be folded into the cartridge 1. In this way, the folded material is transferred from the cartridge 1 to the pair of folding rollers 11, 12 which runs with the same circumferential speed as the rollers 13 to 16. The fold previously formed between the edge 6 of the cartridge and the feed roll 9 is thus pressed together. At the same time, the next material to be folded can be introduced into the cartridge 1 at the edge 31 of the cartridge which is opposite to the edge 6 of the cartridge as it has been explained for the preceding cartridge position in connection with FIGS. 5 and 6 and, subsequently, the process explained in connection with FIGS. 7 to 10 can be repeated with this next material to be folded.

According to FIGS. 1 and 5 to 20, two feed rolls 9, 10 and four additional rollers 19 to 22 are provided. Of these, only the one feed roll 9 is used during the repeated processes according to FIGS. 5 to 10 or 11 to 16 as well as the additional rollers 22 and 19 and only the other feed roll 10 and the other additional rollers 21 and 20 are used during the repeated processes according to FIGS. 17 to 20. Both feed rolls 9 and 10, together with all four additional rollers 19 to 22, make it possible to fold in the one or the other direction without adjusting the folding station only by selecting the direction of rotation of the cartridge (the direction of rotation of the supply rollers 29, 30 and of the folding rollers 11, 12 remains the same, only the direction of rotation of the transport rollers 13 to 16 is reversed after each 180° turn of the cartridge 1).

For example, when producing a simple fold (FIG. 2), the upper sides of the portions a and b of the material to be folded during the introduction of the material into the cartridge 1 (FIG. 5) are outside after the folding process when the cartridge 1 is turned counterclockwise as in FIGS. 7 and 8. With a clockwise turn, the lower sides of the portions a and b during the introduction would be outside. This is of importance when folding addressed letterheads which, in a subsequent operation, are put into envelopes having a window for the address.

Figure 11:
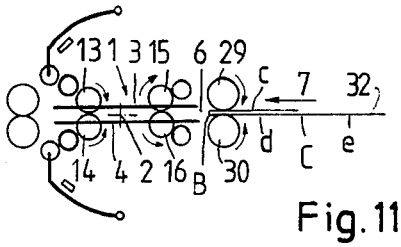
FIGS. 11 to 16 show the processes of the production of the second folding of a Z fold in a like folding station.
Figure 12:
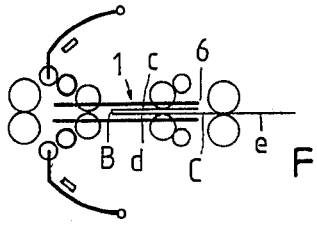

When, in the described folding station, a first third of the material to be folded is folded over in such a manner that it is placed above the second (center) third, as the portions c and d of the material to be folded 32 in FIGS. 11 and 12, whereby B indicates the fold and e the third third, a Z fold (FIG. 3) according to FIGS. 11 to 16 or a rolling fold (FIG. 4) according to FIGS. 11, 12 and 17 to 20 can be obtained by means of a second folding process at point C by passing the material once more through the same station or through a subsequent second station (see the two successive stations I and II in FIG. 1). Also in this connection, there are different possibilities with the first and second folding depending on the direction of rotation of the cartridge 1 on which it depends whether portion c is placed on top of portion d as in FIG. 11 or underneath the portion d, whether a Z fold or a rolling fold is obtained and which parts of the material are outside with the Z fold or rolling fold.

FIG. 1 shows additional structural parts of the folding station, whereby the conditions of the two stations I and II are not coordinated in order to show details, and sheets of different sizes are folded.

Figure 9:
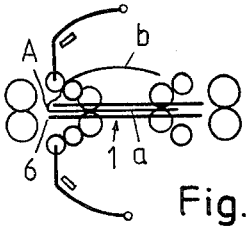
Figure 15:
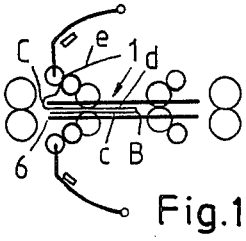
Figure 19:
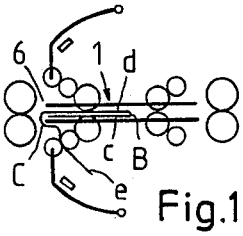

The station I is shown in a condition which is, in time, between the conditions shown in FIGS. 9 and 10 for the case that a sheet a, b is to be folded once in the center at A. The station II is shown in that position which corresponds to the position in FIG. 14 or 18 for the case that the first third of a sheet was folded in station I by forming a simple fold at B and the material prefolded in this manner is continued to be folded to form a Z or a rolling fold. This results in a Z fold when the sheet was folded in station I at its point B in such a fashion that the first third c is placed on top of the second third d (right turn of the cartridge 1 of the station I) and a rolling fold is obtained when the sheet was folded at point B in such a manner that the first third c is placed underneath the second third d (left turn of cartridge 1 of the station I).

According to FIG. 1, guide walls 33 are arranged at the outlet side of the pairs of supply rollers 29, 30 which converge with the introduction of the material to be folded (introduction of the subsequent not shown material to be folded in station I) but diverge when the supply rollers 29, 30 limit the additional roller gap (station II, see also FIGS. 7, 13, 17) from which the material to be folded located between them can be freely pulled out with the turning of the cartridge 1. In order to control the position of the guide walls 33 and the distance of the supply rollers 29, 30 in dependence on the position of the cartridge 1, cams rotating with the cartridge 1 can be provided (not shown). Guide walls 34 are also arranged on the inlet side of the pairs of folding rollers 11, 12. The guide walls 33 and 34 have, just as the guide walls 3 and 4 of the cartridge 1, recesses (not shown) through which the accordingly axially divided rollers 29, 30 or 11, 12 project. A guide for the material to be folded 35 is arranged between the pair of folding rollers 11, 12 of the station I and the pair of supply rollers 29, 30 of the station II. Each cartridge 1 is equipped with two guide walls 36 which keep the projecting portion b or e of the material away from the rollers 13 to 16 and 19 to 22.

The guide walls 3 and 4 of the cartridge 1 can, as shown in FIG. 1 for the stations I and II, be pivoted in such a way and, for example, controlled in such a way by a stationary cam (not shown) that they close the cartridge 1 after the introduction of the material to be folded on the introduction side (edge 6 or 31) in order to clamp down the material to be folded at this point and to hold it in a defined position when the feed roll 9 or 10 runs over this side whereupon the walls 3 and 4 open up again in order to permit the transfer of the folded material to the pair of folding rollers 11, 12. The introduction of the material to be folded is also facilitated by means of a larger distance between the guide walls 3, 4. The same can also be achieved with regard to guide walls which cannot be moved towards each other by equipping them with movable lips (not shown) which can also be controlled by a stationary cam with the turn of the cartridge 1. The stops 25, 26 can, for example, be controlled by a cam (not shown) rotating with the cartridge 1 in such a way that the feed rolls 9, 10 have each the most favorable position in order to run on the edge 6 or 31 of the cartridge on the additional rollers 19 to 22. The feeding force can also be controlled by cams.

A light barrier (not shown) is expediently arranged at the outlet side of each pair of supply rollers 29, 30 which responds to the front edge of the material to be folded in the direction of the introduction and then triggers a control process by means of which the drive of the rollers 29, 30 and 13 to 16 is controlled in accordance with the advance length by which the material to be folded is to be advanced further in order to get the material to be folded, i.e. the point to be folded, to the edge 6 or 31 of the cartridge towards the pair of supply rollers 29, 30. The distance corresponding to the advance length of the front edge of the material to be folded from this edge of the cartridge is adjustable on the control system (not shown) of the machine.

When the cartridge 1 is turned, the axes of the transport rollers 13 to 16 run on circular paths around the axis line 2 and, with this, the transport rollers 13 to 16 must stand still relative to the cartridge 1. When the cartridge 1 is in its resting position and stands still, the transport rollers 13 to 16 must be driven. Three planetary gears, connected in series, according to FIGS. 21 and 22 or a wheel gear and a coupling according to FIG. 23 serve this purpose.

Figure 22:
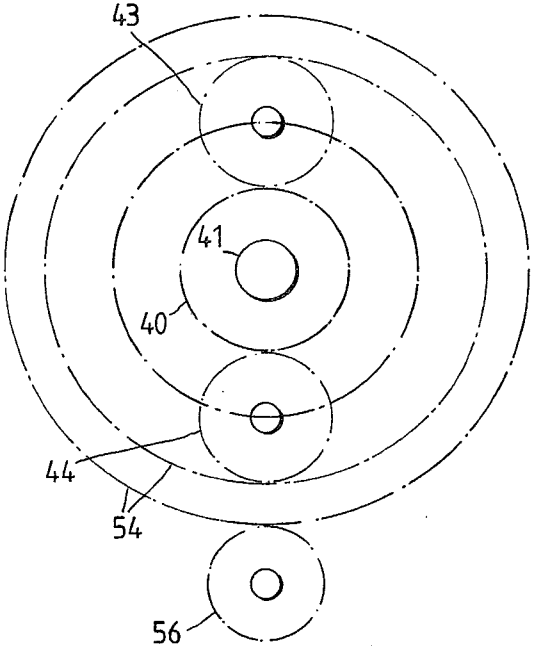
FIG. 22 shows a schematic axial section according to the line XXII—XXII in FIG. 21.
Figure 23:
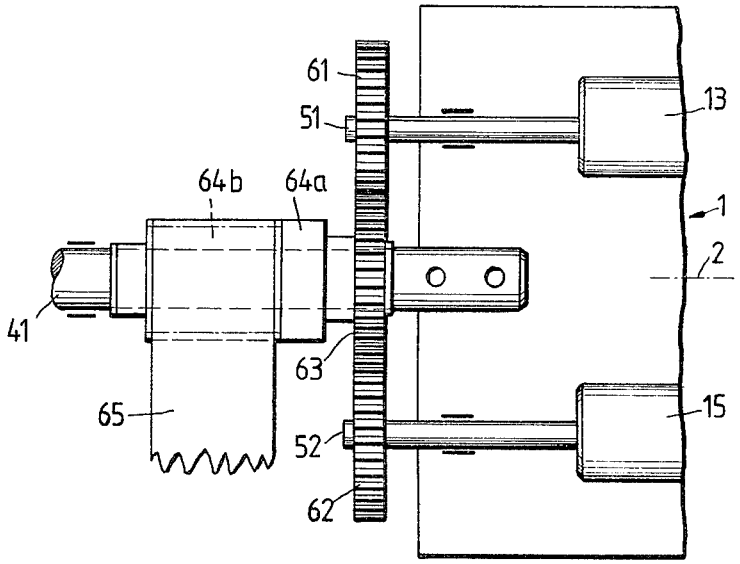
FIG. 23 shows a schematic top view of another design of a driving device for the transport rollers.

According to FIGS. 22 and 23, the sun wheel 40 of the first planetary gear is rigidly mounted on a shaft 41 which is rigidly connected with the cartridge 1 and which can be driven always by 180° for the turning of the cartridge 1, for example, by an accordingly controlled motor. A crosspiece 42 is pivoted on the shaft 41 on which the planetary wheels 43, 44 and 45, 46 of the first and of the second gear rest. The sun wheels 47 and 48 of the second and third gear pivot also on the shaft 41; they are rigidly connected with each other, in the example they are jointly made of one piece.

The planetary wheels 49 of the third gear are placed on one shaft each 51 or 52 pivoted on the cartridge 1 of a roller 13 or 15 of one of the two pairs of transport rollers. The other roller 14 or 16 (not shown in FIGS. 21 and 22) of each pair of transport rollers is driven by a pair of identical gear wheels (not shown) of which one gear wheel is placed on the shaft 51 or 52 and the other one on the shaft of the other roller 14 or 16 of this pair. The first planetary gear has a pivoted ring 54 with internal toothing and with external toothing. The second planetary gear has a stationary ring 55 with internal toothing. A gear wheel 56 meshes with the external toothing of the ring 54 and this gear wheel is driven, for example, by a correspondingly controlled stepping motor (not shown) in order to drive the transport rollers 13 to 16, with the cartridge 1 standing still, in accordance with the advance length of the material to be folded. The three planetary gears have identical sun wheel 40, 47, 48 and identical planetary wheels 43 to 46, 49, 50 and thus also identical internal toothing of the rings 54 and 55.

When the cartridge 1, and thus also the sun wheel 40 rigidly connected with it, stands still and the gear wheel 56 is driven, the planetary wheels 43, 44 perform their planetary movements. Since they are rigidly connected with the planetary wheels 45, 46 and rest with them on the same crosspiece 42, the planetary wheels 43 to 46 must perform the same planetary movements. Since the planetary wheels 45, 46 mesh with the internal toothing of the stationary ring 55, they carry along the sun wheel 47 and thus the sun wheel 48 which forms one piece with the former one. It rotates on the shaft 41 and drives the transport rollers 13, 15 and thus also the transport rollers 14, 16 through the planetary wheels 49, 50 and the shafts 51 and 52.

When the driving gear 56 stands still and the cartridge 1 is turned, the sun wheel 40 turns as well and drives the planetary wheels 43, 44 which run on the internal toothing of the ring 54 that is standing still. Since both rings 54 and 55 stand still, the planetary wheels 43, 44 are rigidly connected with the planetary wheels 45, 46 and rest on the same crosspiece 42 as the former, the sun wheels 47 and 48 which are made of one piece perform the same turn as the sun wheel 40 which is rigidly connected with the cartridge 1. Thus, the sun wheel 48 turns necessarily with the cartridge 1 and, since the shafts 51 and 52 of the planetary wheels 49, 50 and transport rollers 13, 15 (and 14, 16) rest on the cartridge 1, the planetary wheels 49, 50 and thus the transport rollers 13, 15 (and 14, 16) stand still relative to the cartridge 1 when the cartridge 1 is turned while the driving wheel 56 stands still.

According to FIG. 23, a gear wheel 61 or 62 is placed on an end of the shaft 51 or 52 of the transport rollers 13 or 15 projecting beyond the cartridge 1. The gear wheels 61 and 62 mesh with a gear wheel 63 which is rigidly connected with the element **64*a* of an adjustable coupling 64*a*/64*b* and rests freely movable together with this coupling element 64*a* on the shaft 41. The other coupling element 64*b* is also freely movable on the shaft 41. It is provided with an external toothing over which a tooth belt 65** runs of a belt drive which is not shown.

In order to drive the transport rollers while the cartridge stands still, the coupling **64*a*/64*b* is connected and the coupling element 64*b* is driven by the belt drive. The coupling element 64*b* then carries along the coupling element 64*a* with the gear wheel 63 and the gear wheel 63 drives the gear wheels 61 and 62 and thus the transport rollers 13 and 15. Before the cartridge 1 is turned, the coupling 64***a*/64*b* is disconnected. With the turn of the cartridge 1, the coupling element 64*b* stops then while the gear wheels 61, 62, 63 (and the coupling element 64*a*) turn as an entity around the axis of rotation 2 together with the cartridge 1 so that the transport rollers 13 and 15 stand still, as required, relative to the cartridge 1.

The coupling 64*a*/64*b* can be designed in a power or shape locking manner, particularly as an electromagnetic coupling. Since the transport rollers 13 and 15 are driven to the same extent and in turn in the one direction and in the opposite direction, the electrical connecting lines of the electromagnetic coupling can be installed screw line like or spiral like around the axis 41 with a sufficient number of windings permitting the necessary turning in order to avoid sliding contacts.

In each folding station of the present folding machine, material of different sizes can be folded at a selected point and this in the one or the other direction depending on the direction of rotation of the cartridge without having to perform any structural changed just by selecting the advance length of the material to be folded. In this way, either a simple fold or the first or the second fold of a Z fold or rolling fold is obtained. Also, by selecting the direction or directions of rotation of the cartridge, it can be achieved that, for example, a portion of the material carrying an address comes to be outside of the folded material independently of whether it was on top or underneath when it was fed into the machine. One portion of the material to be folded remains plane during all processes in each folding station so that this portion can have inflexible components, such as, for example, paper clips, a credit card or flat samples and they would not get damaged or would impede the operation of the machine.

I claim:

1. A machine for folding material consisting of one or several sheets to be folded, jointly, having at least one folding station, comprising a cartridge (1) including two guide walls (3,4) defining a space therebetween for receiving a portion (a; c,d) of the sheet material and having two opposite gap-like end openings each defined between a pair of coresponding edges of said walls (3,4);

means mounting said cartridge to rotate about an axis (2,41) transverse to said cartridge and to repeatedly turn said cartridge (1) by 180° from one rest position to another, said axis (2,41) being arranged along a center line between said end openings of said cartridge (1) so that said end openings move on a common circular path during turning of said cartridge (1);

a pair of supply rollers (29,30) connected adjacent said common circular path and operable for supplying said material to be folded toward said cartridge (1) for introducing said portion (a; c, d) of said sheet material into said space of said cartridge (1) through one of said end openings thereof;

at least one pressure roller (9,10), means (23,24) resiliently mounting said at least one pressure roller (9,10) adjacent said circular path for movement on a path crossing said circular path and resiliently urging said at least one pressure roller in an inward direction toward said axis thereof for rolling engagement with one of said pairs of edges of one of said guide walls (3, 4) and on an outer face of that guide wall (3, 4) adjacent that edge as the cartridge rotates about its axis, said portion (a;c,d) of said sheet material being introduced into said space in a substantially parallel position between said guide walls with said portion (b;e) to be folded extending outside of said walls, whereby the rotation of said cartridge causes said pressure roller to pre-fold said portion (b;e) of said sheet material to be folded about said one edge;

a pair of withdrawing and final folding rollers (11,12) connected adjacent said common circular path and operable for withdrawing said sheet material from said cartridge (1) and for finally folding said pre-folded material by said pressure roller (9,10);

said pair of supply rollers (29, 30) and said pair of withdrawing and final folding rollers (11,12) each adjoining one of said two end openings of said cartridge (1) in each of said rest positions thereof and said pressure roller (9, 10) being situated beside said pair of pressure and final folding rollers (11,12); and at least one pair of transport rollers (13,14,15,16) on said cartridge (1), means connected to operate said at least one pair of transport rollers in an advanced controlled manner during stand still of the cartridge (1) to transport within said space of said cartridge (1) said portion (a; c,d) of said sheet material supplied by said supply rollers (29, 30) and to move out of said space said portion (a; c, d), thereby moving said material (a, b; c, d, e) to said pair of withdrawing and final folding rollers (11,12), and during turning of said cartridge (1) to stand still for holding said portion (a; c,d) of said material stationary within said space.

2. A machine as set forth in claim 1, including at least one additional roller (19–22) connected on at least one end of the cartridge (1) between one end opening and said at least one pair of transport rollers (13, 14, 15, 16) and connected to be driven by the latter, said at least one additional roller (19–22) movable into contact with said at least one pressure roller (9,10) following the pre-folding of the portion (b; e) of the material to be folded by the pressure roller (9, 10), whereby the portion (b; e) of the material to be folded is gripped between said pressure roller (9, 10) and said additional roller (19–22) and is advanced in close overlying relation with the portion (a; c, d) of the material in said space to the pair of withdrawing and final folding rollers (11, 12) upon operation of said at least one pair of transport rollers (13, 14, 15, 16).

3. A machine according to claim 1, in which said guide walls (3, 4) of the cartridge (1) having at least one area adjacent to the introductory side adapted to be moved to clamp down the material to be folded between the pair of corresponding edges (6, 31) of said walls (3, 4) and is in a clamping position during the turning of said cartridge (1).

4. A machine according to claim 1, including an additional roller (19 to 22) arranged on at least one end of the outer side of at least one of the guide walls (3,4) of the cartridge (1) at a distance from the cartridge corresponding edge (6,31), said pressure roller (9, 10), after having run over one of said pairs of edges of the cartridge on the introductory side (6,31) is adapted to be resiliently urged against said additional roller during the transfer of the material to be folded (5,32) to the pair of pressure and final folding rollers (11, 12), said additional roller (for example, 22) connected to be driven by the transport roller adjacent to it (16) of said at least one pair of transport rollers (13 to 16), and said pressure roller (for example, 9) and said additional roller (22) being drivingly when said pressure roller (9) is pressed against said additional roller (22) so that said pressure roller and said additional roller rotate at the same circumferential roller speed.

5. A machine according to claim 4, in which said pressure roller (9, 10) is spring-loaded, a stop (25, 26) connected to hold the spring-loaded pressure roller (9, 10) in its resting position, said spring loaded pressure roller connected to be movable as a function of the turning of the cartridge (1) from a suitable position for the running of the pressure roller (9, 10) on one cartridge edge of said pair of edges (6, 31) to a position against the additional roller (19 to 22) when the cartridge edge (6, 31) and the additional roller (19 to 22) successively approach said pressure roller.

6. A machine according to claim 1, in which said pair of supply rollers (29, 30) having a roller gap which is enlarged after the feeding of said portion (a; c,d) of the sheet material (5; 32) into said space of the cartridge (1) to such an extent that the portion (b; e) of the material to be folded (5; 32) which has remained in the roller gap can be freely pulled out.

7. A machine according to claim 6, in which said pair of pressure and final folding rollers (11, 12) and said pair of supply rollers (29, 30) are arranged at 180° relative to the axis (2) of the cartridge, and said means connected to turn said cartridge (1) by 180° about said axis (2) being connected to reverse the direction of rotation of the at least one pair of transport rollers (13 to 16) after each 180° turn of the cartridge (1).

8. A machine according to claim 7, including two pairs of transport rollers (13/14, 15/16) on the cartridge (1), said means connected to turn said cartridge includes three planetary gears, connected in series, and connected to drive said at least one pair of transport rollers (13 to 16), a shaft (41) rigidly connected with the cartridge (1) and adapted to be driven to turn the latter, said first planetary gear having a sun wheel (40) connected rigidly to said shaft to turn the same, a crosspiece (42) carrying the planetary wheels (43, 44 and 45, 46) of the first and of the second planetary gears, a pair of sun wheels (47 and 48), of the second and third planetary gears, being rigidly connected with each other and rotatable on the shaft (41), a rotary ring gear (54) included in said first planetary gear and forming the driving element and having internal toothing, and the second planetary gear having a rigidly arranged ring gear (55) with internal toothing, and a pair of planetary wheels (49,50) of the third planetary gear connected with the sun wheel (48) thereof and having shafts (51,52) connected with the cartridge (1) to drive the pairs of transport rollers (13, 14 and 15, 16), and said first and the second planetary gears having identical planetary wheels and identical sun wheels.

9. A machine according to claim 7, including two pair of transport rollers (13/14, 15/16) on the cartridge (1), one gear wheel each (61, 62) rigidly connected with the transport rollers (13, 15) of the pairs of transport rollers (13/14, 15/16) to be driven in the same direction, a gear wheel (63) connected coaxial to the axis of rotation (2) of the cartridge (1) and connected in meshing relation with said one gear wheel each (61, 61), and a connectable coupling (**64*a*/64*b*) connectable to drive said gear wheel (63) and which is disconnected during the turning of the cartridge (1**).

* * * * *